US007592893B2

(12) United States Patent
Kennedy et al.

(10) Patent No.: US 7,592,893 B2
(45) Date of Patent: Sep. 22, 2009

(54) MULTIPLE CONDUCTOR INDICATOR

(75) Inventors: John Kennedy, Tuscola, IL (US); Tom Novak, Charleston, IL (US); Mark Klinger, Arcola, IL (US); William Gonzalez, Charleston, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 12/145,321

(22) Filed: Jun. 24, 2008

(65) Prior Publication Data

US 2008/0258856 A1 Oct. 23, 2008

Related U.S. Application Data

(62) Division of application No. 10/183,615, filed on Jun. 26, 2002, now Pat. No. 7,405,646.

(51) Int. Cl.
*H01H 85/30* (2006.01)
*G08B 21/18* (2006.01)

(52) U.S. Cl. ..... 337/243; 337/206; 337/241; 116/206; 116/207; 340/638

(58) Field of Classification Search ..... 337/241–243, 337/245, 265, 266, 206; 324/507, 550; 439/490, 439/491; 340/638, 639; 116/202, 206, 207
See application file for complete search history.

(56) References Cited

U.S. PATENT DOCUMENTS

| | | | | | |
|---|---|---|---|---|---|
| 737,280 | A * | 8/1903 | Sachs | 337/243 |
| 792,530 | A * | 6/1905 | Marshall | 337/243 |
| 809,978 | A * | 1/1906 | Ogle | 337/243 |
| 821,873 | A * | 5/1906 | Hoffmann | 337/241 |
| 866,716 | A * | 9/1907 | Cole | 337/243 |
| 1,014,741 | A * | 1/1912 | Barringer et al. | 337/243 |
| 1,040,150 | A * | 10/1912 | Cole | 337/243 |
| 1,087,120 | A * | 2/1914 | Hooker | 337/243 |
| 1,591,029 | A * | 7/1926 | Feldkamp | 337/243 |
| 2,164,658 | A * | 7/1939 | Lyon | 337/242 |
| 2,175,250 | A * | 10/1939 | Burrows et al. | 337/243 |
| 2,206,784 | A * | 7/1940 | Linton | 337/242 |
| 2,737,552 | A * | 3/1956 | Hitchcock | 337/229 |
| 3,513,427 | A * | 5/1970 | Browne et al. | 337/243 |
| 4,142,151 | A * | 2/1979 | Hansen | 324/767 |

(Continued)

FOREIGN PATENT DOCUMENTS

DE 3743482 A1 * 7/1989

*Primary Examiner*—Anatoly Vortman
(74) *Attorney, Agent, or Firm*—Duane Morris LLP

(57) ABSTRACT

One embodiment of the present invention provides a fuse having opened-fuse indication, which places two or more coils or conductors in parallel and in thermal contact with an indicating material. The multiple conductors allow a lower level of current to produce sufficient heat or sufficient electrical resistance to transform the indicating material. The multiple conductors can also be made of a reduced diameter, resulting in surge protection at a lower device temperature. The multiple conductor indicator in an embodiment includes a base material. First and second conductors contact the base material. An indicating material thermally couples to the first and second conductors. The indicating material can be on the inside or outside of the fuse body. If on the outside, the body can define a recess, wherein the indicator resides within the recess. The indicator can operate with fuses and other types of circuit protection devices.

7 Claims, 4 Drawing Sheets

U.S. PATENT DOCUMENTS

| | | | | | |
|---|---|---|---|---|---|
| 4,308,516 | A | | 12/1981 | Shimada et al. | |
| 4,404,536 | A | * | 9/1983 | Still | 337/201 |
| 4,527,143 | A | * | 7/1985 | Thienel | 337/242 |
| 4,641,120 | A | | 2/1987 | Bonfig et al. | |
| 4,760,367 | A | * | 7/1988 | Williams | 337/241 |
| 5,111,177 | A | | 5/1992 | Krueger et al. | |
| 5,345,210 | A | | 9/1994 | Swensen et al. | |
| 5,673,028 | A | * | 9/1997 | Levy | 340/635 |
| 5,781,095 | A | | 7/1998 | Dietsch et al. | |
| 5,821,849 | A | | 10/1998 | Dietsch et al. | |
| 5,841,337 | A | | 11/1998 | Douglass | |
| 5,936,508 | A | * | 8/1999 | Parker | 337/241 |
| 5,994,993 | A | * | 11/1999 | Castonguay et al. | 337/206 |
| 6,456,189 | B1 | * | 9/2002 | Mosesian et al. | 337/243 |
| 6,859,131 | B2 | * | 2/2005 | Stanek et al. | 337/206 |
| 2002/0175800 | A1 | * | 11/2002 | Stanek et al. | 337/206 |

* cited by examiner

MULTIPLE CONDUCTOR INDICATOR

BACKGROUND OF THE INVENTION

The present invention relates generally to overcurrent and overvoltage indication for electrical devices. More particularly, the present invention relates to fuses having opened-fuse indication.

Known fuses exist that open if a short circuit occurs or if a current overload condition occurs. For example, some known fuses include a short circuit element in series with a current overload or time delay element. The combination of fuse elements electrically communicates with a pair of terminals, which respectively electrically communicate with a pair of electrically conductive end caps. The end caps of the fuse typically snap-fit into well-known fuse clips.

When one of the above described types of fuse elements opens, it is desirable that the fuse indicates its opened state to an operator. For this reason, known fuses also exist that provide opened-fuse indication. There are various types of opened-fuse indicators. Some known fuses provide a spring loaded mechanism, wherein the opened-fuse triggers a spring that moves a plunger to a more visible location. Other fuse indicators provide a resistive circuit in parallel with the fuse element, wherein the highly resistive circuit includes a light emitting diode ("LED") or lamp in parallel with the fuse element. Normally, virtually all the current flows through the fuse element such that the little amount of current that does travel through the highly resistive circuit does not illuminate the LED. When the fuse opens, the current is forced through the highly resistive circuit, illuminates the LED and provides opened-fuse indication.

Littelfuse, Inc., the assignee of the present invention, provides an opened-fuse indicator which has a clear or transparent plastic lens that makes an internal fluorescein coated indicator coil visible to an operator. The opened-fuse indicator provides a circuit that is in parallel with a fuse element. The resistance of the indicator coil is substantially higher than the resistance through the fuse element, so that current normally travels through the fuse element. When the fuse element melts, the main circuit opens, and current shunts through the resistive indicator coil, causing the coil to heat up and vaporize the fluorescein into a colored gas. The colored gas collects on the interior of the transparent plastic lens and provides opened-fuse indication.

Another type of opened-fuse indicator includes a clear or transparent plastic lens that makes an internal ball of white "gun cotton" visible. Gun cotton ignites and disappears when subjected to flames, sparks or temperatures of about 280° F. (138° C.). An igniter wire, which is in parallel with a fuse element, runs through the gun cotton. A black background exists behind the gun cotton, which is normally not visible to the operator. When the fuse element melts, current shunts through the igniter wire, and the wire heats to a temperature above the ignition temperature of the gun cotton. The gun cotton burns away, exposing the black background and providing opened-fuse indication.

A further type of opened-fuse indicator includes a flexible label attached to the exterior of the fuse body. The label has a semi-conductive layer fixed to the outside of the fuse body, which is connected in parallel with a fuse element. A temperature responsive layer is disposed on the outside of the semi-conductive layer and normally blocks the operator from seeing the background. The resistance in the semi-conductive layer is substantially higher than that of the fuse element.

In normal operation, most of the current runs through the fuse element, and the small amount of current that runs through the semi-conductive layer does not produce enough heat to raise the temperature of the responsive layer above its transition temperature. If the current in the circuit exceeds the amperage permitted by the fuse element, the fuse opens and allows current to shunt though the semi-conductive layer. The semi-conductive layer heats the temperature responsive layer above its transition temperature, whereby the responsive layer changes to a generally transparent state and permits a color of the semi-conductive layer to become visible.

While the above described indicating fuses have provided adequate opened-fuse indication, a continuing need exists to provide more dependable and cost effective indicating fuses. Also, a continuing need exists to provide an opened-fuse indicator that indicates at a lower operating temperature.

Most of the currently available opened-fuse indicators are provided inside of the electrical fuse. Consequently, size becomes an issue. Typically, the lower the rating of the fuse, the smaller the size of the fuse. It becomes increasingly difficult to place the above-described fuse indicators inside of the fuses for increasingly smaller fuses. A need therefore exists to provide an opened-fuse indicator for lower rated fuses.

Further, a need exists to provide overcurrent or overvoltage indication for electrical devices besides fuses. That is, it is desirable to know if particular electrical devices have been subjected to a surge current or voltage.

SUMMARY OF THE INVENTION

The present invention provides a multiple conductor indicator. More specifically, the present invention provides a multiple conductor indicator that places two or more coils or conductors in parallel and in thermal contact with an indicating material. When an opened-fuse condition occurs, the multiple coils each act to heat the indicating material. Consequently, neither coil has to draw as much current or rise to a temperature that would be required if only one coil was present. The dual coils operate at a relatively lower current and temperature to transform the indicating material and indicate an opened-fuse condition.

To this end, in one embodiment of the present invention, a multiple conductor indicator is provided. The multiple conductor indicator includes a base material. A first conductor contacts the base material. An indicating material contacts the first conductor. A second conductor contacts the indicating material.

In an embodiment, the indicating material contacts the first conductor and the base material.

In an embodiment, the indicating material contacts one side of the base material.

In an embodiment, the first conductor wraps around the base material.

In an embodiment, the second conductor wraps around the indicating material and the base material.

In an embodiment, at least one of the first and second conductors is a wire.

In an embodiment, at least one of the first and second conductors is constructed from tin plated copper.

In an embodiment, at least one of the first and second conductors is energy producing.

In an embodiment, at least one of the first and second conductors includes differing metals that alloy rapidly resulting in a reaction that produces a higher temperature than the temperature needed to trigger the alloying of the metals.

In an embodiment, the base material is selected from the group consisting of: a vulcanized fiber material, melamine, paper, plastic, ceramic and any combination thereof.

In an embodiment, the base material includes multiple layers.

In an embodiment, the indicating material includes a substrate having a coating. The substrate can include paper and the coating can include wax.

In an embodiment, the indicating material is selected from the group consisting of: a wax, an ink, a liquid crystal, a dye, and any combination thereof.

In an embodiment, the indicating material changes color upon an opened-fuse condition.

In an embodiment, an underlying layer of the base material or the indicating material becomes visible upon an opened-fuse condition.

In another embodiment of the present invention, a multiple conductor indicator is provided. The multiple conductor indicator includes an indicating material. First and second conductors contact the indicating material. The first and second conductors electrically connect in parallel.

In an embodiment, the first and second conductors electrically connect in parallel with an electrical device. The electrical device can include a fuse element.

In an embodiment, the first and second conductors physically contact each other in at least one place.

In an embodiment, the multiple conductor indicator includes a third conductor thermally coupled to the indicating material and electrically connected in parallel with the first and second conductors.

In a further embodiment of the present invention, a fuse having a multiple conductor indicator is provided. The fuse includes a housing. A fuse element is disposed within the housing. A first conductor is also disposed within the housing. An indicating material contacts the first conductor. A second conductor contacts the indicating material. The first and second conductors form individual electrical paths with the fuse element.

In an embodiment, the first conductor, indicating material and second conductor are disposed about a base material.

In an embodiment, the fuse includes a pair of terminals attached to the housing. The fuse element, the first conductor and the second conductor electrically communicate with the pair of terminals.

In an embodiment, the fuse includes a pair of terminals attached to the body. The fuse element, the first conductor and the second conductor electrically communicate with the pair of terminals.

In still another embodiment of the present invention, a fuse having a multiple conductor indicator is provided. The fuse includes a body. A fuse element is disposed within the body. An indicating material is disposed outside the body. First and second conductors individually electrically communicate in parallel with the fuse element and contact the indicating material.

In an embodiment, the indicating material includes a substrate having a coating.

In an embodiment, the fuse includes a pair of terminals attached to the body. The fuse element, the first conductor and the second conductor electrically communicate with the pair of terminals.

In an embodiment, the fuse element electrically communicates in parallel with first and second conductors.

In an embodiment, at least a portion of the first and second conductors resides outside the fuse body.

In an embodiment, a portion of each of the first and second conductors is individually, electrically insulated.

In an embodiment, the outside of the body defines a recessed area and the indicating material resides within the recessed area.

In an embodiment, at least a portion of the first and second conductors resides within the recess.

In an embodiment, the recessed body is made by a process selected from the group consisting of: machining, extruding, and molding or any combination of same.

In an embodiment, the fuse includes a covering disposed outside the body and the indicating material. The covering allows visual indication of the indicating material.

In an embodiment, the covering includes a material selected from the group consisting of: an electrically insulative material, a thermally insulative material or a combination thereof.

In an embodiment, the indicating material attaches to the body by a mechanism selected from the group consisting of: an adhesive or adhesive wrap, a snap-fit, a screw, a rivet, a press-fit, heat staking, liquid adhesive, epoxy preform, or any combination thereof.

Moreover, in an embodiment of the present invention a single conductor fuse is provided. The fuse includes a body having an outside defining a recess. A fuse element is disposed within the body. An indicator is disposed outside the body in the recess. A single conductor connects to the indicator so as to cause an opened-fuse indication when the fuse element reacts to an opened-fuse causing event.

In an embodiment, the conductor physically connects to the indicator.

In an embodiment, the conductor electrically connects to the indicator.

In an embodiment, the indicator includes: gun cotton, a light-emitting diode, a fluorescein coating, a temperature responsive layer or any combination thereof.

In an embodiment, a plurality of end caps electrically connect to the fuse element and are wider than the body. The recess enables the indicator to be disposed so as not to extend wider than the end caps.

In an embodiment, a plurality of end caps electrically connect to the fuse element and are radially larger than the body. The recess enables the indicator to be disposed so as not to radially extend past the end caps.

In an embodiment, a portion of the conductor is individually, electrically insulated.

In still another embodiment of the present invention, a device having circuit protection and a multiple conductor indicator is provided. The device includes a body having a circuit protection device disposed therein. First and second conductors are provided that individually electrically connect in series or parallel with a circuit protection device. In one embodiment, the device further includes a thermal element placed in series with the circuit protection device. Here, the first and second conductors operate in parallel with the thermal element. In any case, an indicating material contacts the first and second conductors and indicates, for example, when the circuit protection device has seen an abnormal overcurrent or overvoltage surge.

In an embodiment, the first and second conductors electrically connect in parallel with respect to each other.

In an embodiment, the body is that of a metal oxide varister ("MOV"), a voltage variable material ("VVM") device, a positive temperature coefficient ("PTC") device or any other type of circuit protection device.

In an embodiment, a base material is provided that supports the indicating material.

In an embodiment, the electrical leads are configured to mount to a printed circuit board.

In yet another embodiment of the present invention, a multiple conductor indicator device is provided for removably coupling to a circuit protection device. The indicator device includes a body having first and second terminals, the terminals positioned and arranged to removably couple to a circuit protection device, such as an MOV, VVM device or PTC device. First and second conductors are disposed within the body and communicate respectively with the first and second terminals. An indicating material is provided that thermally couples to the first and second conductors.

In an embodiment, the first and second terminals removeably couple to at least one electrical lead of the circuit protection device.

In still another embodiment of the present invention, a method for providing a multiple conductor indicator is provided. The method includes providing an indicating material. The indicating material contacts a first conductor. The indicating material contacts a second conductor. The first and second conductors are electrically connected in parallel.

In an embodiment, the method includes providing a base material, attaching the first conductor to the base material, applying the indicating material to the base material and the first conductor and attaching the second conductor to the indicating material.

In an embodiment, the method includes electrically coupling leads and a fuse element to the first and second conductors.

In an embodiment, the method includes electrically coupling leads to the first and second conductors, wherein the leads are adjacent to the indicating material.

In an embodiment, the method includes electrically coupling leads to the first and second conductors, wherein at least one of the leads passes through the indicating material.

In an embodiment, the method includes physically contacting the leads in at least one place.

Moreover, in an embodiment a method of using a thermal indicator is provided. The method includes providing a thermal indicator having a body with a plurality of terminals. The terminals each electrically connect to one of a plurality of conductors. The indicator couples to the plurality of conductors. In an embodiment, the indicator is housed inside the body of a circuit protection device. In another embodiment, the indicator and body are removably attachable to electrically connect the terminals of an electrical device. The electrical device may or may not be a circuit protection device. The indicator may or may not couple to a plurality of coils, wherein the coils connect in parallel to the conductors.

It is therefore an advantage of the present invention to provide a fuse having opened-fuse indication.

A further advantage of the present invention is to provide a multiple conductor indicator that indicates an opened-circuit due to an overvoltage or overcurrent situation.

Another advantage of the present invention is to provide a multiple conductor indicator that indicates and opens the circuit at a lower overall device temperature.

Moreover, an advantage of the present invention is to provide a fuse having a dependable opened-circuit indicator.

Still further, an advantage of the present invention is to provide a fuse having an inexpensive opened-circuit indicator.

Still another advantage of the present invention is to provide a method of manufacturing a device having a dependable and inexpensive surge event indicator.

Yet another advantage of the present invention is to provide an indicator that operates with multiple types of circuit protection devices.

Additional features and advantages of the present invention will be described in and apparent from the Detailed Description of the Preferred Embodiments and the Drawings.

DETAILED DESCRIPTION OF THE PREFERRED EMBODIMENTS

Figure 1:
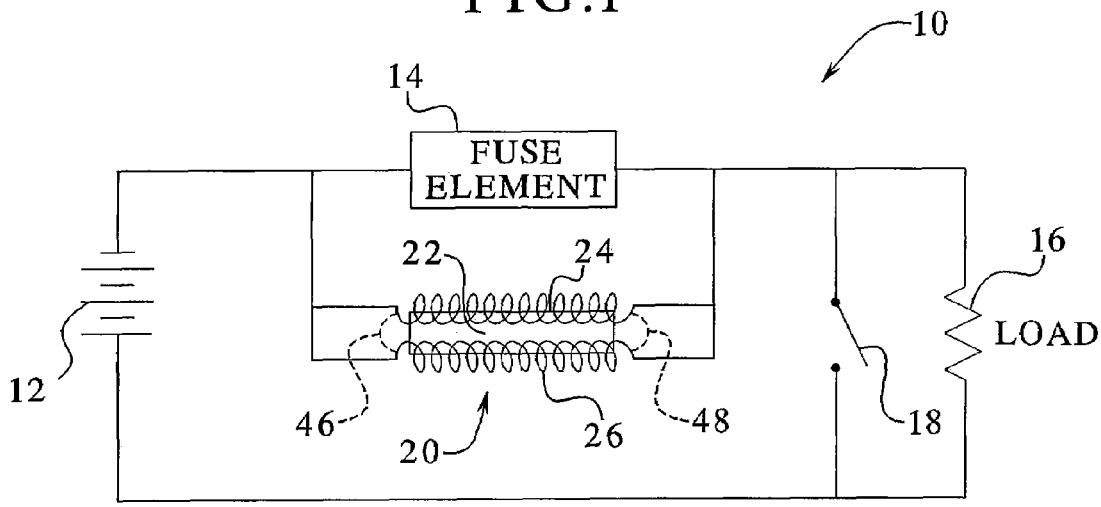
FIG. 1 is a schematic electrical diagram showing a fuse element a multiple conductor indicator of the present invention.

Referring now to the drawings and in particular to FIG. 1, a schematic circuit diagram of an electrical circuit 10 of the present invention is illustrated. The circuit 10 includes a voltage source 12, a fuse element 14 and a load 16 that are connected in series. A switch 18 is normally open and represents a short circuit causing device. That is, no current normally flows through the switch 18. Rather, current normally flows from the voltage source 12 through the fuse element 14 and the load 16. The load 16 includes any type of electrical device that provides a sufficient resistance such that the current that normally flows through the load 16 is less than the current necessary to open the fuse element 14.

An overcurrent or overvoltage condition is schematically represented in the circuit 10 when the switch 18 closes or is in a closed state, which short circuits the load 16. Thus, the switch 18 simulates a device that has a defect or has worn or for any other reason causes a short circuit of the load 16.

Due to the lessened or nominal resistance of the switch 18, the short circuiting of the load 16 typically causes the current that flows through the circuit 10 and the fuse element 14 to increase dramatically. The increased current through the circuit 10 causes the fuse element 14, which is normally conducting, to become electrically open or non-conducting. This is typically called an opened-fuse element 14. As discussed below, once the fuse element 14 has opened, all of the voltage appears across a multiple conductor indicator 20.

The multiple conductor indicator 20 has a high resistance relative to the fuse element 14 in a non-opened state, i.e., when the fuse element 14 is conducting. The multiple conductor indicator 20 is connected to the circuit 10 in parallel with the fuse element 14. The majority of the current normally flows through the fuse element 14. The resistance of multiple conductor indicator 20 dictates the small amount of current that normally does flow through the multiple conductor indicator 20 does not change the state of or change the appearance of the indicator 20.

When the fuse element 14 opens, all of the current produced by voltage source 12 shunts through the parallel path of the multiple conductor indicator 20. The high amount of current shunted through the multiple conductor indicator 20 causes a visual change in an indicating material 22 to occur which indicates an opened-fuse state. The multiple conductor indicator 20 in an embodiment opens up after the visual change of the indicating material 22.

The indicating material remains visibly changed even after the multiple conductor indicator 20 opens, that is, even when no more current flows through the multiple conductor indicator 20. In this manner, the multiple conductor indicator 20 is irreversible. Once the material 22 changes states to indicate an opened-fuse, the visual indication remains wherein an operator can view the fuse having the opened-fuse indication at any time after the fuse has opened.

FIG. 1 schematically illustrates the electrical configuration of the multiple conductor indicator 20 of the present invention. The indicating material 22 contacts or couples to a plurality of conductors or coils 24 and 26. It should be appreciated that a first conductor 24 is electrically connected in parallel with a second conductor 26. In this manner, both conductors or coils 24 and 26 heat the indicating material 22. Although two conductors or coils are provided in one preferred embodiment of the present invention, the present invention includes the provision of any number of conductors or coils, such as conductors 24 and 26.

Figure 2:
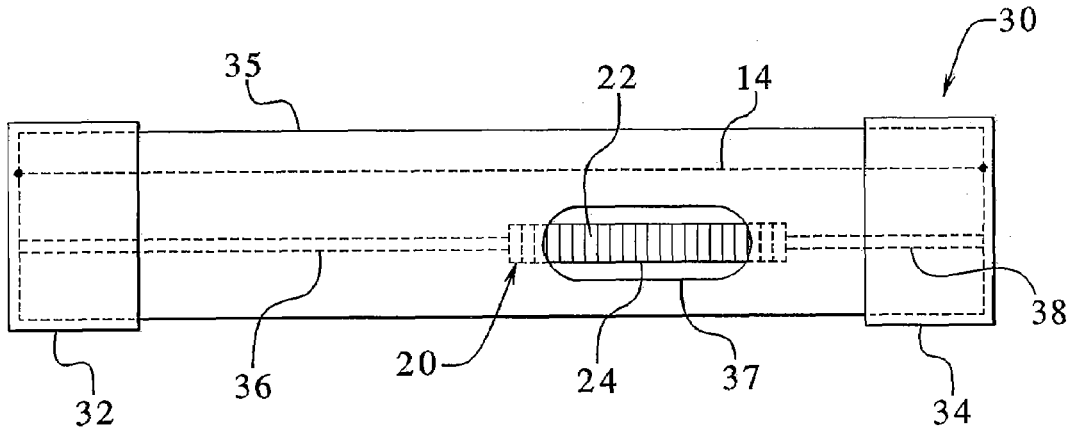
FIG. 2 is a schematic elevation view of one embodiment of a fuse having the multiple conductor indicator of the present invention.

Referring now to FIG. 2, a schematic view of a fuse 30 having the multiple conductor indicator 20 of the present invention is illustrated. The fuse 30 has a pair of end terminals or caps 32 and 34. In an embodiment, the terminals or end caps 32 and 34 are cylindrical in cross-section, however, the terminals or end caps 32 and 34 alternatively have any suitable cross-sectional shape, such as, square, rectangular, ovular, etc. The end caps 32 and 34 are made of any suitable conductive material. For example, the end caps 32 and 34 can be made of copper, zinc, nickel, silver, gold, a conductive alloy or any combination of these.

A body 35 is fixed between the end caps 32 and 34. In an embodiment, the body, like the end caps, is cylindrical in cross-section, however, the body 35 alternatively has any suitable cross-sectional shape, such as, square, rectangular, ovular, etc. The body 35 is made of any suitable insulating material, such as paper, plastic, fibrous materials, silica, melamine, ceramic or any combination of these insulating materials.

The end caps 32 and 34 can be adhered to the body 35 by any method known to those of skill in the art. For example, the end caps 32 in an embodiment are crimped onto the body 35. Although cylindrical end caps are preferred, any shape of end cap and body is possible. The end caps 32 and 34 fit into fuse receptacles or fuse clips as is well known to those of skill in the art.

FIG. 2 illustrates the multiple conductor indicator 20 connecting to end caps 32 and 34 and in parallel with the fuse element 14 via leads 36 and 38. In an alternative embodiment, the leads 36 and 38 are soldered to the end caps 32 and 34, respectively. In an alternative embodiment, the fuse element 14 could connect in parallel directly to the leads 36 and 38. The leads 36 and 38 are made from any desired conductive material, such as any of those disclosed above for the end caps 32 and 34. The leads 36 and 38 can be of a single strand of wire or can be multiple strands of wire that are woven or wrapped together.

The fuse element 14 includes any fuse element known to those of skill in the art. The fuse element 14 opens during an overcurrent event, such as upon a short circuit. The fuse element 14 can include a material that melts upon an overcurrent condition. In a further alternative embodiment, the fuse element 14 includes both overvoltage protection, e.g., point of high electrical resistance, and overcurrent protection, such as a material that melts and opens upon an overcurrent.

The fuse 30 of FIG. 2 includes a viewing window or lens 37. The lens 37 can be made of clear plastic, translucent plastic, mica, glass or any material that permits visual distinction of the indicator state. In an embodiment, the lens 37 is manufactured and attached to the multiple conductor indicator 20 as a sub-assembly before being installed in the body 35. The lens 37 is alternatively, separately fitted into and secured to the body 35 upon manufacturing the fuse 30. The lens 37 enables an operator to view the indicating material 22 in either a normal state or an opened-fuse state. The indicating material 22 has first and second conductors or coils 24 and 26, which in an embodiment are thin but are still visible by the operator.

Either or both coils 24 and/or 26 may be visible to the operator through the lens 37. The multiple conductor indicator 20 and lens 37 can be disposed at any point along the length of the body 35 and in one embodiment are positioned closer to one of the end caps (e.g., end cap 34) than to the other end cap (e.g., end cap 32). The lens 37 can have any shape desired by the manufacturer and in an embodiment is an oval shape as illustrated.

Figure 3:
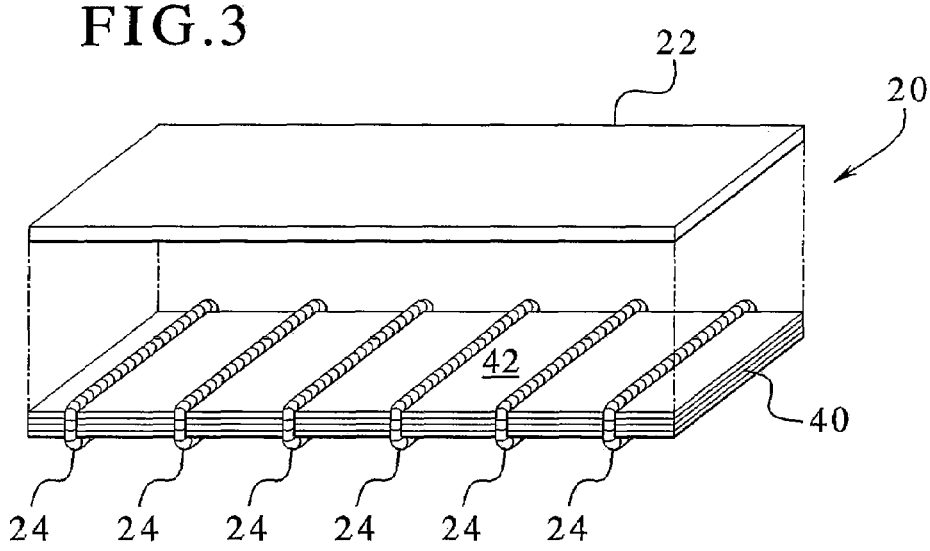
FIG. 3 is a perspective view illustrating one stage in the manufacturing of the multiple conductor indicator of the present invention.
Figure 4:
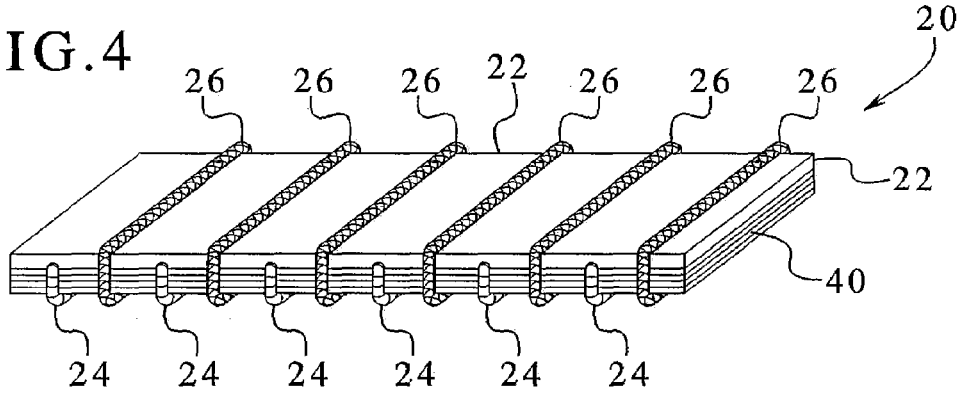
FIG. 4 is a perspective view illustrating another stage in the manufacturing of the multiple conductor indicator of the present invention.

Referring now to FIGS. 3 and 4, the multiple conductor indicator 20 of the fuse 30 of the present invention is illustrated at various stages of manufacture. FIG. 3 illustrates that the manufacture in an embodiment begins with a base material 40. The base material 40 in an embodiment provides a structure or support upon which the coils or conductors of the present invention are applied and upon which the indicating material 22 is applied. In an embodiment, the base material 40 is made from a vulcanized fiber material or alternatively from melamine, paper, plastic, ceramic, silica, etc or any combination thereof. The material in an embodiment is relatively non-conductive and has a high melting temperature relative to the melting temperature of the indicating material 22. The material used for the base material is preferably low cost, flexible and exhibits low arc tracking.

In an embodiment, the base material 40 has multiple layers or leafs. That is, the base material 40 has multiple layers of the vulcanized fiber material, melamine, paper, plastic, ceramic, silica, or uses any combination of same. The multiple layers are pressed or adhered together.

The base material 40 in an embodiment is cut or stamped to be approximately 1.75 inches (4.45 cm) long and approximately 3/16 inch (4.8 mm) wide. In an embodiment, the base material 40 and the indicating material 22 applied thereto are slightly less wide than the width of the lens 37. In this way, the operator can see both the width of the indicating material 22, which faces outward toward the operator, and a background on either side of the indicating material 22, which provides a reference to see the indicating material.

FIG. 3 illustrates that the first coil or conductor 24 is wound around the base material 40. FIG. 4 illustrates that the second coil or conductor is wound around the base material 40 and the indicating material 22. The conductors 24 and 26 in an embodiment are made from any desirable conductive material. In one embodiment, the coil 24 and 26 are tin plated copper. In other embodiments, any type of conducting wire or conductive strand may be employed. The conductors 24 and 26 can be single or multi-stranded wire. In other embodiments, the conductors 24 and 26 can be a conductive ribbon or other type of flexible, relatively strong tensile material.

Further, the conductors 24 and 26 can themselves provide energy to heat the indicating material 22. The energy producing conductors 24 and 26 in an embodiment include two or more suitable contacting metals. When an opened-fuse condition causes the contacting metals to heat, the differing metals alloy rapidly resulting in instant deflagration without the presence of oxygen. The differing metals are chosen such that the temperature produced by the reaction is less than the temperature needed to trigger the alloying of the metals. The energy producing conductors 24 and 26 enable the overall indicating temperature to be lower and/or enable the indicating material 22 to heat more efficiently and reliably.

The conductors 24 and 26 wind about the base material 40 and permanently deform or otherwise remain wound or attached to the base material 40 without the need for excessive additional means for attachment. However, it is also contemplated that the conductors 24 and 26 can be adhered or otherwise fixed to the base material 40.

The first coil or conductor 24 is wound about the base material 40 at approximately a pitch of sixty turns or wraps per inch (2.54 cm). The winding process can be any known to those of skill in the art. The first coil or conductor 24 is preferably wound at a sufficient pitch so that current shunted through the single coil 24 can heat the coil 24 enough to melt the indicating material 22.

The indicating material 22 as illustrated is applied to a top or visible surface 42 of the base material 40. In another embodiment, the indicating material 22 can be applied to multiple surfaces of the base material 40 (e.g., by coating base material 40 into a liquid bath of indicating material 22). However, it is most practical to apply the indicating material 22 to only the surface 42 that the operator sees through lens 37.

In an embodiment, the indicating material 22 is white wax. Any material that provides a visual change by electrical or thermal stimulation, however, may be employed. Further, any color of wax may be employed for the indicating material 22. The indicating material 22 is disposed on the base material 40 by printing, coating, or through other known deposition processes. The color, opacity or translucidity of the indicating material 22 is chosen to provide the desired response or contrast when the fuse element 14 opens. For example, the white wax can be contrasted against a dark or black base material 40.

In an embodiment, the indicating material 22 includes a wax or resin coated substrate. The substrate can be paper or synthetic. That is, the indicating material 22 itself can have an underlying support, e.g., the substrate or paper layer. This type of paper is commonly referred to as thermal paper. Thermal paper can be purchased having a variety of wax or resin colors and a variety of different colored underlying substrates, including differently colored paper or synthetic. Any suitable combination of thermal paper colors (e.g., dark paper/light wax or light paper/dark wax) may be employed. Using the wax or resin coated substrate indicating material 22, it is possible to provide the indicator 20 of the present invention without providing a separate base material 40.

When in an unmelted state, the wax indicating material 22 acts to scatter light incident on the multiple conductor indicator 20 causing the multiple conductor indicator to appear white or the color of the wax. When the fuse element 14 opens and current shunts through the multiple coils 24 and 26, the shunted current heats the wax above its melting temperature, wherein the wax becomes substantially more light transmissive. The base material 40, which in one preferred embodiment is a dark color, becomes visible through the melted wax indicating material 22. Thus the operator sees the dark base material 40 instead of the light wax indicating material 22 when the fuse element 14 has opened.

In other embodiments, a dark wax indicating material 22 may be employed in combination with a light base material 40. It should be appreciated that any contrasting visible characteristics between the base material 40 and the wax indicating material 22, such as color, pattern, reflectiveness, surface smoothness, etc., may be employed to indicate an opened-fuse state.

Alternatively, the indicating material 22 includes an ink or dye that covers the base material 40. In various embodiments, the dye is an organic dye or an inorganic phosphor acting as luminescence converter (LUCO) dye. The indicating material 22 further alternatively includes a liquid crystal material that changes color when thermally stimulated.

When the circuit 10 exceeds the amperage permitted by the fuse 30, the fuse opens allowing substantially greater current to flow through the multiple conductor indicator 20. The current heats the ink or dye to a predefined temperature to cause the ink or dye to change color and reveal the base material 40 beneath. Further alternatively, the indicating material 22 includes a liquid crystal. Still further, the indicating material 22 can include any combination of a wax, an ink, a dye and a liquid crystal.

FIG. 4 illustrates another step in the manufacture of the multiple conductor indicator 20 of the present invention, which includes wrapping at least one other coil or conductor 26 about the indicating material 22 and base material 40. FIG. 4 illustrates that the multiple conductor indicator 20 includes the initial wrapping of the first conductor 24, which is now located between the base material 40 and the coated or clipped indicating material 22. The second wrapping of the second coil 26 takes place around the top of the indicating material 22.

Both the first and second conductors 24 and 26 in an embodiment wrap around the bottom of the base material 40. The second coil 26 wraps about the base material 40 and the indicating material 22 using the same method used for the first coil 24. The coil or wire that is visible to the operator in FIG. 2 is thus the second coil 26, which is wrapped on top of the indicating material 22.

The bottom surface of the base material 40 includes both the wrappings of the first conductor 24 and the second conductor 26. The second conductor 26 in an embodiment is made of any of the materials specified above for the first conductor 24 and can be made of a different material or the same material as the first conductor 24, e.g., a tin plated copper wire. The second conductor 26 in an embodiment is wound at a different rate than the coil 24, for example, forty-five coils per inch (2.54 cm). Alternatively, the outer coil 26 and the inner coil 24 are wrapped or wound at the same pitch.

In an embodiment, the second conductor 26 is wrapped around the base material 40 such that it does not contact the first coil 24. In FIG. 1, the solid lines of the schematic circuit diagram show that the coils 24 and 26, while placed in parallel, do not contact each other.

In an alternative embodiment, the second conductor 26 is wrapped around the base material 40 such that it does contact the first coil 24. In FIG. 1, the dashed lines 46 and 48 indicate that, while placed in parallel, there is at least one and more likely a multitude of points of contact between the first and second conductors 24 and 26. The points of contact create multiple and alternate current flow paths, which results in reliable opened-fuse indication. That is, if one of the coils 24 or 26 melts or breaks, the cross-linked coils 24 and 26 will likely enable the opened coil to continue conducting.

The double wrapping of coils or conductors 24 and 26 enables the indicator 20 to operate more efficiently during high current activation and enables indication to occur at a lower temperature during low current activation. These improvements are with respect to an indicator 20 having only a single coil or wrapping. That is, upon an overcurrent or overvoltage condition in the circuit 10, the parallel paths of the conductors of the multiple conductor indicator 20 heat the indicating material 22 on multiple surfaces and from multiple directions.

At high levels of overcurrent, the multiple conductors 24 and 26 enable the color change material 22 to change states faster with less total input energy because the multiple conductors or coils heat the color change material 22 more efficiently. This results in the coils not heating to as high a temperature as would occur with a single conductor or coil.

The provision of multiple conductors or coils 24 and 26 also enables coils of a reduced cross-sectional diameter to be employed. The reduced cross-sectional diameter of the multiple coils 24 and 26 enables the coils 24 and 26 to melt or self-destruct at a lower temperature than the temperature needed to melt larger diameter wires of a single coil device. This results in a fuse 10 having an opened-fuse indication that occurs at a relatively lower temperature.

It should be appreciated that the present invention is not limited to dual coils 24 and 26 as illustrated. The present invention can include any number of conductors or coils as desired by the manufacturer. Further, in an embodiment the coils 24 and 26 are provided such that either could become hot enough alone to cause the indicating material 22 to change upon a large voltage spike or large overcurrent.

Figure 5:
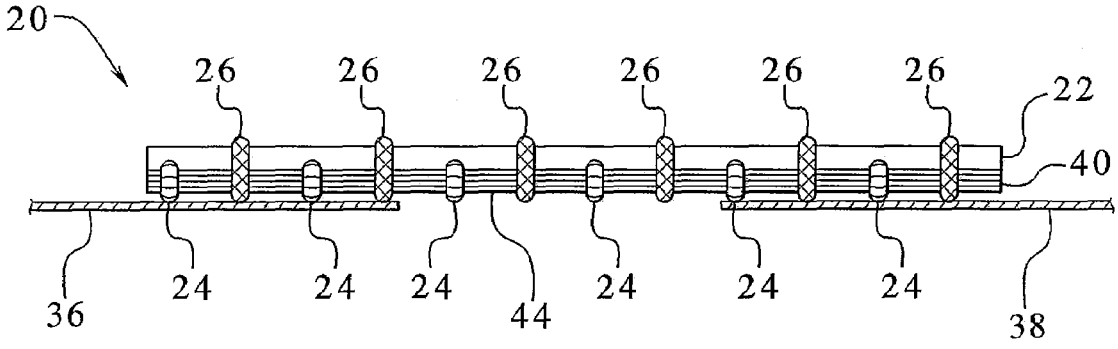
FIG. 5 is a schematic elevation view of one embodiment of the finally manufactured multiple conductor indicator of the present invention.

Referring now to FIG. 5, a side or elevation view of the opened-fuse indictor 20 is illustrated. The leads 36 and 38 are shown individually electrically connected to both conductors 24 and 26 in a preferred embodiment, wherein both conductors 24 and 26 contact a bottom surface 44 of the base material 40. The bottom surface 44 provides a convenient place to electrically couple the leads 36 and 38 to the multiple coils 24 and 26. Alternatively, leads could also connect to the top side of the multiple conductor indicator 20. The leads 36 and 38 connect to both coils 24 and 26, i.e., to all coils of the present invention. Each of the conductors, e.g., coils 24 and 26, are thereby connected in parallel relative to each other and are collectively connected in parallel with respect to the fuse element 14.

In an alternative embodiment (not illustrated), the leads 36 and 38 solder to the coils 26 along the top of the fuse indicator 20. Here, the base material 40 and indicating material 22 define one or more apertures that enable the leads 36 and 38 to extend from the top of the indicator 20, through the base material 40 and indicating material 22, and through the bottom surface 44 of the base material 40. The leads 36 and 38 extend around the bottom surface 44 and electrically couple to the coils 24. The apertures or holes can be punched through the base material 40 and indicating material 22.

FIG. 2 and FIG. 5 illustrate a single lead 36 extended in one direction from the multiple conductor indicator 20 and a single lead 38 extending from another direction of the multiple conductor indicator 20. In an alternative embodiment, multiple leads can extend in various directions from the multiple conductor indicator 20, which preferably collectively connect in parallel with the fuse element 14 of the fuse 30.

Figure 6A:
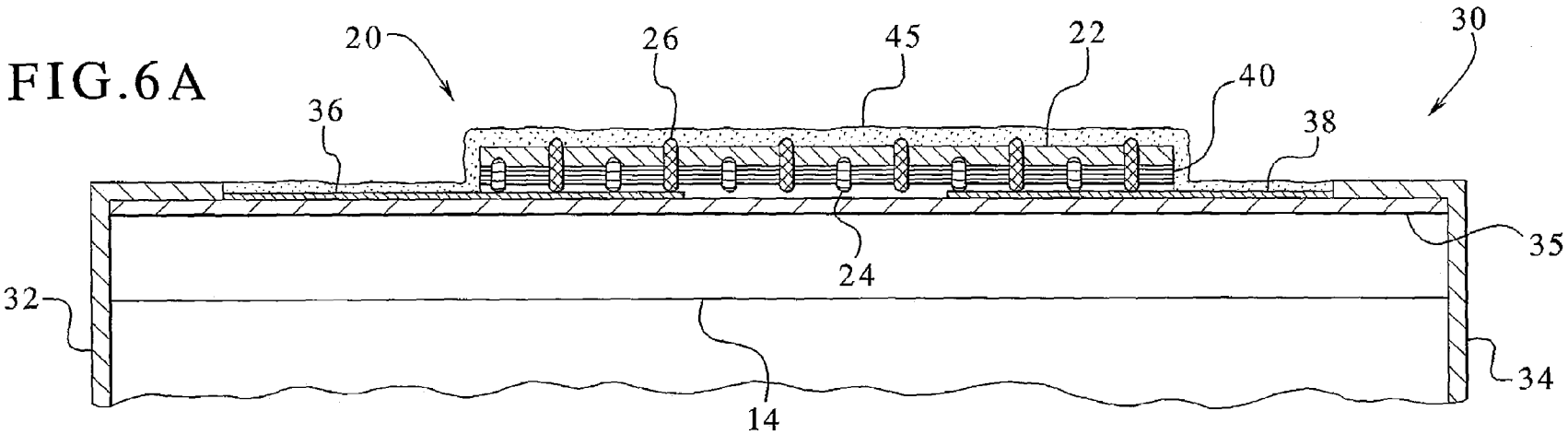
FIG. 6A is a sectional schematic diagram illustrating a further embodiment of a fuse having the multiple conductor indicator of the present invention, wherein the multiple conductor indicator resides outside the fuse body.
Figure 6B:
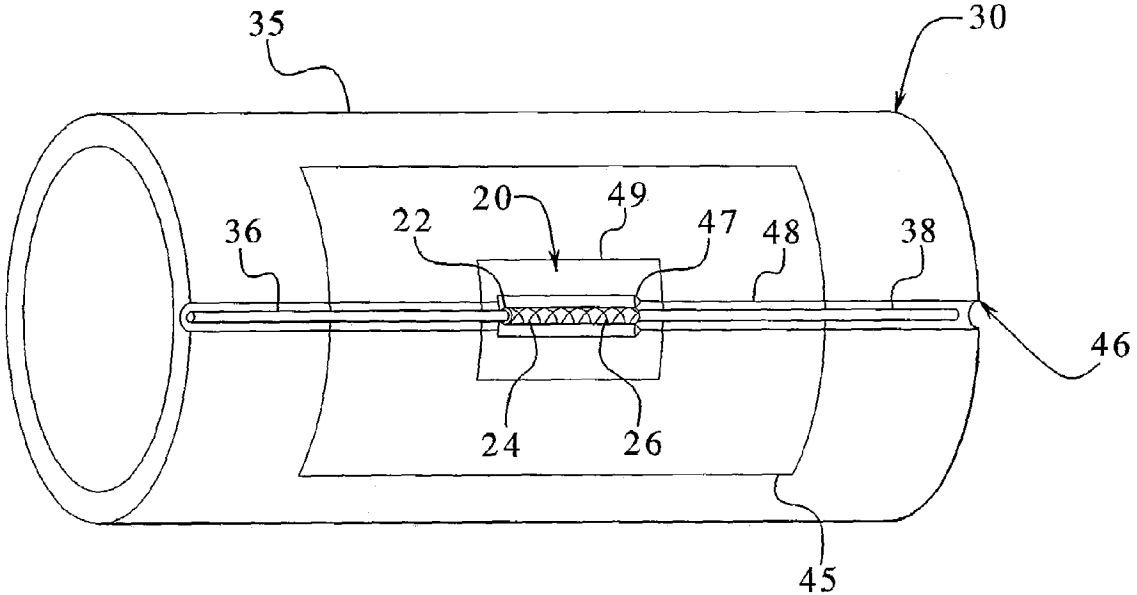
FIG. 6B is a perspective schematic diagram of the fuse of FIG. 6A, wherein the body of the fuse defines a recessed area for disposing the multiple conductor indicator of the present invention.

Referring now to FIGS. 6A and 6B, another embodiment of the present invention is illustrated, wherein the multiple conductor indicator 20 electrically connects outside the fuse body 35 of the fuse 30. The externally mounted indicator 20 is especially useful for smaller (rated and physically smaller) fuses, which do not have enough room to house the multiple coil indicator 20. FIG. 6A shows a sectional view of the fuse 30 having the same components and each of the embodiments relating thereto as described above. The end caps 32 and 34 electrically communicate with fuse element 14, which resides within the body 35.

The multiple conductor indicator 20 resides outside the body 35 as does at least a portion of the leads 36 and 38. The illustrated embodiment shows the entire leads 36 and 38 disposed outside the body 35, wherein the leads directly, electrically connect the indicator 20 to the end caps 32 and 34. In an alternative embodiment, a portion of the leads 36 and 38 extend through the body 35 and electrically connect to the end caps 32 and 34, respectively, and in parallel with the fuse element 14. Here, the fuse element could connect in parallel directly to the leads 36 and 38.

The leads 36 and 38 electrically connect to the conductors 24 and 26 of the indicator 20 via any of the methods disclosed above including soldering or via a separate electrical connector (not illustrated). The indicator 20 is illustrated as having the base material 40, however, especially with the body 35 acting as a support, the base material 40 may be excluded, wherein only the indicating material 22 is used. The indicating material 22 in an embodiment includes a coated substrate. In an alternative embodiment, the indicating material 22 is simply a coating applied to the conductors 24 and 26 and the body 35.

The conductors 24 and 26 are enabled to have smaller cross sectional diameters than if only a single conductor is provided. The alternative fuse 30 includes two, three or more conductors, wherein the individual conductors may or may not contact each other in one or more places. The indicator 20 attaches to the body 35 of the fuse 30 by any suitable means including: using an adhesive, press-fitting the indicator 20 under an outer layer attached to the body 35, snap-fitting, screwing, riveting, press-fitting, heat staking, liquid adhering, epoxying, etc.

One or more protective coverings 45 reside above the indicator 20 and may cover a portion or all of the leads 36 and 38. In an embodiment, the protective covering 45 is an adhesive label. At least a portion of the protective covering is clear or translucent and enables visual observation of the indicating material 22. This portion performs the same function as the lens 37 described above. The protective covering 45 also electrically and thermally isolates the indicator 20 and can also isolate some or all of the leads 36 and 38.

FIG. 6B illustrates one possible embodiment of the fuse 30 of FIG. 6A, wherein the body defines a recess 46. The recess 46 can be formed in a number of ways. First, material can be removed from the body 35. Second, material or protrusions can be added to the body 35 around and defining the recess 46. The body 35 defining the recess 46 is prepared by any suitable method including: machining, extruding and molding, wherein the body 35 includes any of the materials specified above.

It is desirable that the externally mounted indicator 20 and covering 45 not extend radially further than the end caps 32 and 34, so that the fuse 30 can clip into a fuse holder in any direction without the fear of the indicator 20 and covering 45 becoming an obstruction. If the body 35 has a non-cylindrical shape, the end caps have a larger width or profile than the profile of the body 35 together with the indicator 20 and covering 45. The recess enables the indicator 20 and covering 45 to maintain a lower profile. The recess and the external mounting also enable the indicator 20 and the leads 36 and 38 to be very securely fastened to the fuse 30.

The recess 46 includes an indicator portion 47 and a lead portion 48. The indicator portion 47 in an embodiment is wider and may be deeper to accommodate the indictor 20. The lead portion 48 of the recess 46 may house some or all of the leads 36 and 38. The protective covering or label 45 may cover a portion or all of the leads 36 and 38 and conductors 24 and 26. Alternatively, a portion of each of the leads 36 and 38 and/or conductors 24 and 26 not protected by the covering 45 may be individually isolated, for example, be an insulated wire.

The protective covering or label 45 in an embodiment is adhesive and sticks to the body 35. The covering 45 can also have an additional layer of insulation 49, which can be electrical and/or thermal insulation. The additional insulation 49 covers at least the indicator 20. Accordingly, the additional insulation 49, like the covering 45, is at least partly clear or translucent.

When the fuse 30 has a body 35 that defines the recess 46, the fuse indicator placed into the recess 46 is, in an embodiment, the multiple coil indicator 20. The recess 46 forms another aspect of the present invention, however, which is expressly not limited to the multiple coil indicator 20 of the present invention. Any single coil or conductor indicator that can be suitably sized to fit into the indicator portion 47 of the recess 46 may be alternatively employed. The single conductor fuse indicator could include an LED, gun cotton, a fluorescein coating, a temperature responsive layer, metal foil, sputtered metal or any combination of these. The fuse indicator can therefore either electrically connect with the leads 36 and 38, as in the case of an LED, or thermally connect with the single conductor (for example one of either of the conductors 24 or 26), as in the case with the gun cotton, the fluorescein coating, the temperature responsive layer, metal foil or sputtered metal.

Figure 7A:
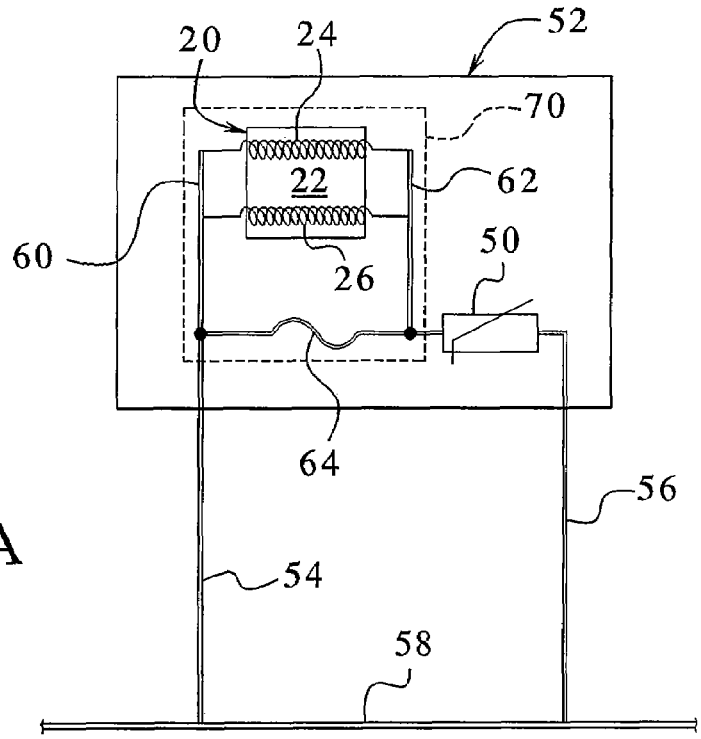
FIGS. 7A and 7B are schematic diagrams illustrating another embodiment of the multiple conductor indicator of the present invention, wherein the multiple conductor indicator couples to a non-fuse type of circuit protection device.
Figure 7B:
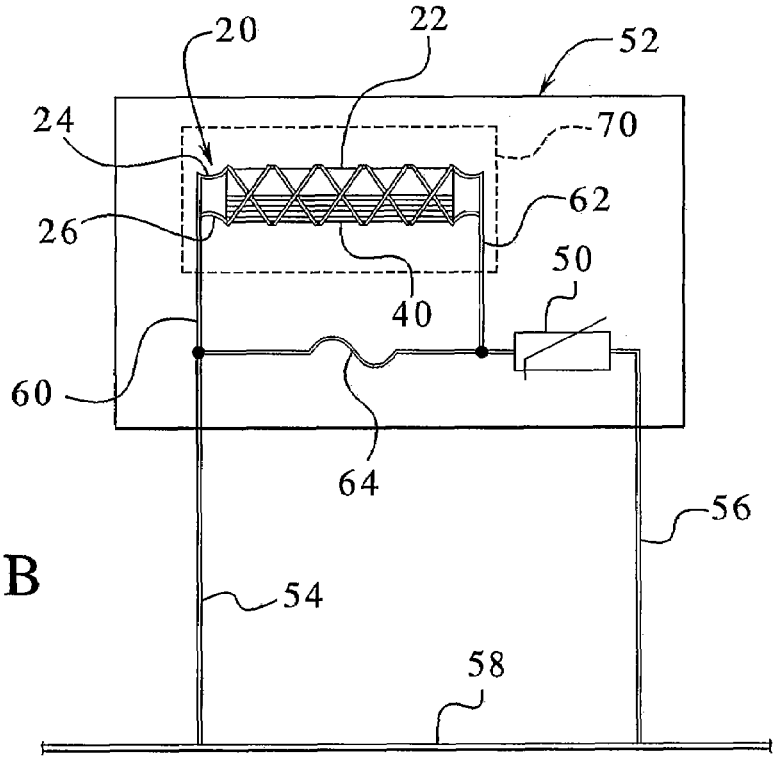

Referring now to FIGS. 7A and 7B, another embodiment of the present invention is illustrated, wherein the multiple conductor indicator 20 electrically connects to an electrical device 50. In the above-described embodiments, the multiple conductor indicator 20 electrically connects to a fuse element 14. However, the multiple conductor indicator 20 of the present invention may be used to indicate that an electrical device has been subjected to an overvoltage or overcurrent situation. While the multiple conductor indicator 20 does not provide surge protection from an overvoltage or overcurrent situation, it is still desirable in certain situations to know that one or more components has been subjected to same.

The electrical device 50 can be any of a variety of different types of circuit protection devices. For example, the electrical device 50 can include: a metal oxide varister ("MOV"), a positive temperature coefficient ("PTC") component, a voltage variable material ("VVM") component and any combination thereof. The electrical device 50 can be rated for any practical voltage and current.

The device 50 includes a body 52 that encloses the functioning portion of the electrical device 50. Leads 54 and 56 extend from the body 52 and electrically and physically connect the device 50 to, for example, a printed circuit board 58. The device 50 may or may not be a surface mount electrical device. The printed circuit board 58 merely illustrates one implementation for electrically connecting the electrical device 50. The device 50 is alternatively a plug-in or socket type or has any other suitable mounting configuration.

The multiple conductor indicator 20 that electrically couples to the electrical device 50 includes each of the embodiments described above with the fuse 30. The multiple conductor indicator 20 includes any of the embodiments and types disclosed above for the indicating material 22. The indicating material can be applied to a base material or be a thermal paper type that includes a coated substrate (therefore not needing a separate base material) as described above.

The multiple conductor indicator 20 includes any of the embodiments disclosed above for the conductors 24 and 26. The conductors 24 and 26 can overlap and contact each other at one or more points to create multiple current paths and a high reliability fuse as discussed above. There can be any desired number of conductors, such as conductors 24 and 26, including only a single conductor, and the conductors are enabled to have reduced cross-sectional diameters with respect to single coil indicators as stated above.

FIG. 7B illustrates the indicator 20 rotated ninety degrees with respect to the electrical device 50. The difference in orientation of the indicator 20 in FIGS. 7A and 7B affects the operator's orientation to the device 50 to visually identify a surge indication. FIG. 7B illustrates the base material 40 in combination with the indicating material 22 and the conductors 24 and 26. Leads 60 and 62 electrically couple the multiple conductor indicator 20 to the leads 54 and 56.

In the illustrated embodiment of FIGS. 7A and 7B, the indicator 20 operates with an MOV 50 and an integrated thermally activated element 64. The element 64 opens in the event of overheating due to abnormal overvoltage or overcurrent conditions. Otherwise, the MOV 50 is resettable upon typical overvoltage or overcurrent conditions. In the illustrated embodiment, the indicator 20 cooperates with a TMOV™ or iTMOV™ device produced by the assignee of the present invention. As stated above, the indicator 20 can cooperate with other types of electrical devices and the present invention is not limited to MOV's. Furthermore, the indicator 20 in an embodiment operates with the electrical device 50 without an additional thermal element 64. In such a case, one or more resistors may be placed in series or parallel with the indicator 20.

In the illustrated embodiment, the indicator 20 is placed in parallel with the thermally activated element 64 and therefore heats up and indicates an open condication very quickly after the element 64 opens. Normally, the MOV 50 switches to a high resistance state as a result of an overvoltage or overcurrent condition. When an abnormal temperature increase occurs, the element 64 opens and the indicator 20 indicates that an abnormal overvoltage or overcurrent condition has occurred. It should be appreciated that the indicator 20 may be placed in series or parallel arrangement with other types of electrical devices, depending upon the device and to achieve a desired electrical result.

Upon an abnormal overcurrent or overvoltage condition, enough current travels through the thermal element 64, wherein the element 64 opens. Thereafter, the coils 24 and 26 heat up enough to cause the indicating material 22 to change state and indicate a surge condition. Certain electrical devices 50, such as an MOV, will react to an overcurrent or overvoltage condition and then reset once the surge condition dissipates. The indicator 20 in the illustrated embodiment will not show that a normal surge condition occurred, only an abnormal condition. In another embodiment, the indicating material 22 is resettable, such as a resettable wax, in which case the indicator 20 may be connected with the MOV 50 in such a way that the indicator 20 indicates a normal overcurrent or overvoltage and then returns to a no indication state once the condition is no longer present. The indicator 20, in an embodiment removeably, electrically connects to the leads 54 or 56, for example, through a clip-on or other type of non-permanent attachment. The operator, after viewing and logging the surge condition indication, can then replace the spent multiple coil indicator 20 with a new one.

FIGS. 7A and 7B illustrate that the multiple conductor indicator 20 is placed in an embodiment inside a surge indication device 70, illustrated in phantom, which includes terminals or terminations that removeably attach to one or more of the leads of the device 50, and which may be placed and operated outside the body 52. The device 70 houses the indicator 20 and the leads 60 and 62. FIG. 7A illustrates that device 70 includes the element 64, however, FIG. 7B illustrates that element 64 is not inside device 70. The housing of device 70 is constructed from any of the materials described above for the body 35, including any suitable insulating material, such as paper, plastic, fibrous materials, silica, melamine, ceramic or any combination of these insulating materials. The housing removably operates with any suitable electrical device 50, for example but not limited to, a circuit protection device. In another embodiment, the indicator 20 is simply housed inside the body 52 along with the electrical device 50.

The body 52 or the surge indication device 70 includes a lens (not illustrated), which enables the operator to view the indicator 20 from outside the body 52 or the surge indication device 70. The lens of the surge indication device 70 is constructed from any of the materials described above for the lens 37, including clear plastic, translucent plastic, mica, glass or any material that permits visual distinction of the indicator state.

In an alternative embodiment, the indicator 20 resides outside of the body 52 or the device 70 as described above in connection with FIGS. 6A and 6B. A clear, protective insulative covering is placed over the indicator 20 and allows visual indication of a surge condition and also isolates the electrical components of the body 52 or device 70 from physical contact. This embodiment can also include the recess described above in connection with FIG. 6B.

It should be understood that various changes and modifications to the presently preferred embodiments described herein will be apparent to those skilled in the art. Such changes and modifications may be made without departing from the spirit and scope of the present invention and without diminishing its attendant advantages.

What is claimed is:

1. A fuse having a multiple conductor indicator comprising:

a body;

a fuse element disposed within the body;

a base material disposed within the body;

an indicating material disposed inside the body, the indicating material atop the base material;

a first conductor disposed within the body and contacting and thermally coupled to the base material; and a second conductor disposed within the body and contacting and thermally coupled to the indicating material, the first and second conductors creating a parallel electrical path with the fuse element, wherein the first conductor wraps around the base material only and the second conductor wraps around both the base material and the indicating material.

2. The fuse of claim 1, wherein the indicating material includes a substrate having a coating.

3. The fuse of claim 1, further comprising a plurality of terminals attached to the body, and wherein the fuse element, the first conductor and the second conductor electrically communicate with the terminals.

4. The fuse of claim 1, wherein at least one of the first and second conductors is a coil.

5. The fuse of claim 1, wherein a portion of at least one of the first and second conductors is individually, electrically insulated.

6. The fuse of claim 1, wherein the a majority of the first conductor contacts the base material.

7. The fuse of claim 1, further comprising a lens on the body for viewing the indicating material.

* * * * *